US009347017B2

(12) United States Patent
Vilardo et al.

(10) Patent No.: US 9,347,017 B2
(45) Date of Patent: May 24, 2016

(54) ENGINE LUBRICANTS CONTAINING A POLYETHER

(75) Inventors: Jonathan S. Vilardo, Chardon, OH (US); Patrick E. Mosier, Bay Village, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 13/978,984

(22) PCT Filed: Jan. 11, 2012

(86) PCT No.: PCT/US2012/020874

§ 371 (c)(1), (2), (4) Date: Sep. 16, 2013

(87) PCT Pub. No.: WO2012/097026

PCT Pub. Date: Jul. 19, 2012

(65) Prior Publication Data

US 2014/0038870 A1 Feb. 6, 2014

Related U.S. Application Data

(60) Provisional application No. 61/431,869, filed on Jan. 12, 2011.

(51) Int. Cl.

| | |
|---|---|
| ***C10M 141/10*** | (2006.01) |
| ***C10M 159/22*** | (2006.01) |
| ***C07C 51/15*** | (2006.01) |
| ***C10M 129/54*** | (2006.01) |
| ***C10M 145/24*** | (2006.01) |
| ***C10M 165/00*** | (2006.01) |

(52) U.S. Cl.

CPC ..... *C10M 145/24* (2013.01); *C10M 165/00* (2013.01); *C10M 2207/262* (2013.01); *C10M 2209/103* (2013.01); *C10M 2209/105* (2013.01); *C10M 2215/042* (2013.01); *C10M 2219/046* (2013.01); *C10M 2223/045* (2013.01); *C10N 2230/10* (2013.01); *C10N 2230/42* (2013.01); *C10N 2240/104* (2013.01)

(58) Field of Classification Search

CPC ..... C10M 145/24; C10M 2207/262; C10M 165/00; C10M 2223/045; C10M 2207/04

USPC ..... 508/375, 378, 460, 518

See application file for complete search history.

(56) References Cited

U.S. PATENT DOCUMENTS

| | | | | |
|---|---|---|---|---|
| 5,652,204 | A | 7/1997 | Cracknell et al. | |
| 6,136,052 | A | 10/2000 | Daly | |
| 6,596,674 | B2 | 7/2003 | Botz | |
| 2005/0176593 | A1 * | 8/2005 | Ward et al. | 508/162 |
| 2008/0076686 | A1 | 3/2008 | Nakazato et al. | |
| 2008/0318817 | A1 | 12/2008 | Yagishita | |
| 2009/0156446 | A1 | 6/2009 | McAtee et al. | |
| 2010/0256028 | A1 * | 10/2010 | Brewer et al. | 508/268 |

FOREIGN PATENT DOCUMENTS

| | | |
|---|---|---|
| EP | 1516910 | 3/2005 |
| WO | 2010/048137 | 4/2010 |
| WO | 2011/126736 | 10/2010 |

OTHER PUBLICATIONS

Corresponding PCT International Publication No. WO 2012/097026 Al published Jul. 19, 2012.

Written Opinion from corresponding International Application No. PCT/US2012/020874 dated Mar. 26, 2012.

Search Report from corresponding International Application No. PCT/US2012020874 dated Mar. 26, 2012.

* cited by examiner

*Primary Examiner* — Vishal Vasisth

(74) *Attorney, Agent, or Firm* — David M. Shold; Teresan W. Gilbert

(57) ABSTRACT

A sump-lubricated, spark-ignited engine is lubricated by supplying thereto a lubricant which comprises (a) an oil of lubricating viscosity; (b) a polyether; and (c) a metal-containing detergent. The lubricant has a total phosphorus content of less than 0.075 percent by weight.

17 Claims, No Drawings

ENGINE LUBRICANTS CONTAINING A POLYETHER

This application is a 371 of PCT/US12/20874, filed Jan. 11, 2012, which claims benefit of 61/431,869, filed Jan. 12, 2011.

BACKGROUND OF THE INVENTION

The disclosed technology relates to a lubricant for a sump-lubricated internal combustion engine.

There is a continuing desire to provide lubricants for internal combustion engines with reduced phosphorus content or reduced metal content as measured by sulfated ash (ASTM D 874). This desire is largely motivated by the fact that, while such materials may be quite useful in the lubricant, they may, in a similar manner, make their way into the exhaust stream. Phosphorus and metals in the exhaust, in turn, are believed to interfere with pollution control devices such as exhaust catalyst systems or particulate filters.

Conventional lubricants, with comparatively high levels of additives that contribute phosphorus or metal as measured by sulfated ash, can typically exhibit good lubricant performance. However, current or future lubricants containing lower levels of phosphorus (e.g., <0.06%) and sulfated ash (e.g., <0.80%) can be more difficult to formulate so as to provide adequate performance.

Polyethers of various types have been used in a variety of lubricant and fuel formulations. For instance, U.S. Pat. No. 5,652,204, Cracknell et al., Jul. 29, 1997, discloses lubricating oil compositions for automotive engines containing certain end-capped polyethers. The polyether may comprise from 0.1 to 99%, most preferably from 5 to 25% by weight of the composition.

U.S. Pat. No. 6,596,674, Botz, Jul. 22, 2003, discloses metal working lubricants comprising a primary lubricity component such as a polyether or polyether ester. The primary lubricity component may comprise from about 0.05 to about 5 percent by weight of the liquid composition of matter. The liquid composition of matter may include a diluent which may comprise water.

U.S. Pat. No. 6,136,052, Daly, Oct. 24, 2000, discloses fuel additives comprising a polyether alcohol. Certain formulations of gasoline contain 50 to 300 ppm of polyether fluidizer.

U.S. Publication 2009/0156446, McAtee, Jun. 18, 2009, discloses a lubricating composition, particularly for an internal combustion engine, which includes an antiwear agent which may comprise a polyhydric alcohol with mono-meric units of oxyalkylene groups.

PCT Publication WO 2010/048137, Apr. 29, 2010, discloses reduction of high-aqueous content sludge in a sump lubricated diesel engine, lubricated with a certain lubricating formulation, by including in the lubricant a polyalkylene oxide.

We have now found that certain components, in particular, polyethers (such as polyether fluidizers) normally have little or no effect, or even a negative effect, on lubricant stability when used in conventional lubricants but have beneficial effects when used in low-phosphorus and optionally low-ash formulations.

SUMMARY OF THE INVENTION

The disclosed technology provides a method for lubricating a sump-lubricated, spark-ignited engine comprising supplying to said engine a lubricant which comprises (a) an oil of lubricating viscosity; (b) a polyether; and (c) a metal-containing detergent; said lubricant having a total phosphorus content of less than 0.075 percent by weight.

The disclosed technology further provides a lubricant comprising (a) an oil of lubricating viscosity; (b) 0.1 to 5 percent by weight of a polyether; and (c) a metal-containing detergent; said lubricant having a total phosphorus content of less than 0.075 or less than 0.06 percent by weight.

DETAILED DESCRIPTION OF THE INVENTION

Various preferred features and embodiments will be described below by way of non-limiting illustration.

The amount of each chemical component described is presented exclusive of any solvent or diluent oil, which may be customarily present in the commercial material, that is, on an active chemical basis, unless otherwise indicated. However, unless otherwise indicated, each chemical or composition referred to herein should be interpreted as being a commercial grade material which may contain the isomers, by-products, derivatives, and other such materials that are normally understood to be present in the commercial grade.

One element of the present technology is an oil of lubricating viscosity. Such oils include natural and synthetic oils, oils derived from hydrocracking, hydrogenation, and hydrofinishing, unrefined, refined, re-refined oils or mixtures thereof. A more detailed description of unrefined, refined and re-refined oils is provided in International Publication WO2008/147704, paragraphs [0054] to [0056]. A more detailed description of natural and synthetic lubricating oils is provided in paragraphs [0058] to [0059] respectively of WO2008/147704. Synthetic oils may also be produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be selected from any of the base oils in Groups I-V as specified in the American Petroleum Institute (API) Base Oil Interchangeability Guidelines. The five base oil groups are as follows: Group I: >0.03% sulfur and/or <90% saturates and viscosity index 80 to 120; Group II: ≤0.03% S and ≥90% saturates and VI 80 to 120; Group III: ≤0.03% S and ≥90% saturates and VI>120; Group IV: all polyalphaolefins; Group V: all others. Groups I, II and III are mineral oil base stocks.

The amount of the oil of lubricating viscosity present is typically the balance remaining after subtracting from 100 wt % the sum of the amount of the compound of the invention and the other performance additives.

The lubricating composition may be in the form of a concentrate and/or a fully formulated lubricant. If the lubricating composition of the invention (comprising the additives disclosed hereinabove) is in the form of a concentrate which may be combined with additional oil to form, in whole or in part, a finished lubricant), the ratio of the of these additives to the oil of lubricating viscosity and/or to diluent oil include the ranges of 1:99 to 99:1 by weight, or 80:20 to 10:90 by weight.

The polyether fluidizer component present in the lubricants of the present technology comprises a polyether, a polyetheramine, or mixtures thereof. The polyether of the present invention can be represented by the formula $RO[CH_2CH(R^1)O]_xH$ where R is a hydrocarbyl group; $R^1$ is selected from the group consisting of hydrogen, alkyl groups of 1 to 14 carbon atoms, and mixtures thereof; and x is a number from 2 to 50. The hydrocarbyl group R is a univalent hydrocarbon group, has one or more carbon atoms, and includes alkyl and alkylphenyl groups having 7 to 30 total carbon atoms, such as 9 to 25 total carbon atoms, or 11 to 20 total carbon atoms. The repeating oxyalkylene units may be derived from ethylene oxide, propylene oxide, or butylene oxide. The number of oxyalkylene units x may be 10 to 35, or 18 to 27. The polyether of the present invention can be prepared by various well-known methods including condensing one mole of an alcohol or alkylphenol with two or more moles of an alkylene oxide, mixture of alkylene oxides, or with several alkylene oxides in sequential fashion, usually in the presence of a base catalyst. U.S. Pat. No. 5,094,667 provides reaction conditions for preparing a polyether. Suitable polyethers are commercially available from Dow Chemicals, Huntsman, ICI and include the Actaclear® series from Bayer.

The polyetheramine of the present technology can be represented, in certain embodiments, by the formula $R[OCH_2CH(R^1)]_nA$, where R is a hydrocarbyl group as described above for polyethers; $R^1$ is selected from the group consisting of hydrogen, alkyl groups of 1 to 14 carbon atoms, and mixtures thereof; n is a number from 2 to 50; and A is selected from the group consisting of $—OCH_2CH_2CH_2NR^2R^2$ and $—NR^3R^3$ where each $R^2$ is independently hydrogen or a hydrocarbyl group of one or more carbon atoms, and each $R^3$ is independently hydrogen, a hydrocarbyl group of one or more carbon atoms, or $—[R^4N(R^5)]_pR^6$ where $R^4$ is $C_2$-$C_{10}$ alkylene, $R^5$ and $R^6$ are independently hydrogen or a hydrocarbyl group of one or more carbon atoms, and p is a number from 1 to 7. The polyetheramine may be derived from ethylene oxide, propylene oxide, or butylene oxide. The number of oxyalkylene units n in the polyetheramine may be 10 to 35, or 18 to 27. The polyetheramine of the present technology can be prepared by various well known methods. A polyether derived from an alcohol or alkylphenol as described above can be condensed with ammonia, an amine or a polyamine in a reductive amination to form a polyetheramine as described in European Publication No. EP 310875. Alternatively, the polyether can be condensed with acrylonitrile and the nitrile intermediate hydrogenated to form a polyetheramine as described in U.S. Pat. No. 5,094,667. Suitable polyetheramines include those where A is $—OCH_2CH_2CH_2NH_2$. Polyetheramines are commercially available in the Techron® series from Chevron and in the Jeffamine® series from Huntsman.

As otherwise stated, in one embodiment, the polyether may be represented by the formula $R^1—(—O—R^2—)_n—R^3$ wherein $R^1$ is a hydrocarbyl group of 10 to 24 (or 12 to 15) carbon atoms, each $R^2$ is independently an alkylene group of 2 to 6 (or 3 to 4) carbon atoms, n is 10 to 30 (or 18 to 26), and $R^3$ is H or an alkyl group or $—CH_2CH_2NH_2$ or $—CH_2CH_2CH_2NH_2$ or $—CH_2CHRNH_2$, where R is an alkyl group (especially, methyl or ethyl), e.g., $—CH_2CH(CH_3)NH_2$, or where together $R^1$ and $R^3$ may represent an alkylene group so as to form a cyclic ether. A suitable polyether, which may also be described as a polyether fluidizer, may comprise a reaction product of one unit of (that is, derived from) a hydroxy-containing hydrocarbon and two or more units of (that is, derived from) an alkylene oxide, wherein the hydroxy-containing hydrocarbon contains 1 to 50 carbon atoms and the alkylene group of the alkylene oxide contains 2 to 6 carbon atoms, wherein the reaction product is optionally further reacted with acrylonitrile and hydrogenated to provide a terminal amino group.

The polyether or polyetheramine of the present technology may have a number average molecular weight of 300 or 350 to 5000, in another instance of 400 to 3500, and in further instances of 450 to 2500 and 1000 to 2000.

The polyether (or polyether fluidizer) may be present in the lubricant in an amount of 0.01 or 0.05 or 0.1 or 0.3 or 0.5 to 5 percent by weight, or 0.8 to 4 percent or 1 to 3 percent or 0.1 to 3 percent or 1.5 to 2.5 percent by weight, e.g., about 2 percent by weight.

In one embodiment, the polyether is included in the lubricant as it is supplied to the engine, that is, it may be one of the components of the unused or original lubricant. Alternatively, however, some or all of the polyether may be introduced into the lubricant from the fuel, such as gasoline or a gasoline/alcohol fuel mixture. The polyether may be used, for instance, in a fuel as a lubricity additive, and such additive may make its way into the lubricant in the course of normal operation of the engine. For instance, small amounts of fuel and fuel additives may enter the lubricant by various mechanisms (such as "blow-by"), and the relatively volatile fuel component may evaporate, leaving behind less volatile species such as polyethers. It is believed that the benefits of the present invention will be obtained when the polyether is incorporated into the lubricant by either route, that is, by intentional up-front inclusion or by introduction from the fuel.

Regarding the fuel, any of a variety of fuels may be used. The fuel is normally a liquid at ambient conditions e.g., room temperature (20 to 30° C.). The fuel can be a hydrocarbon fuel, a nonhydrocarbon fuel, or a mixture thereof. The hydrocarbon fuel can be a petroleum distillate to include a gasoline as defined by ASTM specification D4814 or a diesel fuel as defined by ASTM specification D975. In one embodiment, the fuel is a gasoline, and in other embodiments, the fuel is a leaded gasoline or a nonleaded gasoline. In another embodiment, the fuel is a diesel fuel. The hydrocarbon fuel can be a hydrocarbon prepared by a gas to liquid process to include, for example, hydrocarbons prepared by a process such as the Fischer-Tropsch process. The nonhydrocarbon fuel can be an oxygen-containing composition, often referred to as an oxygenate, which can include an alcohol, an ether, a ketone, an ester of a carboxylic acid, a nitroalkane, or a mixture thereof. The nonhydrocarbon fuel can include, for example, methanol, ethanol, propanol, butanol, methyl t-butyl ether, methyl ethyl ketone, transesterified oils and/or fats from plants and animals such as rapeseed methyl ester and soybean methyl ester, and nitromethane. In some embodiments, the fuel can have an oxygenate content on a weight basis of 15 percent by weight, or 25 percent by weight, or 50 percent by weight, or 65 percent by weight, or 85 percent by weight, or 90 percent by weight. Mixtures of hydrocarbon and nonhydrocarbon fuels can include, for example, gasoline and methanol and/or ethanol, diesel fuel and ethanol, and diesel fuel and a transesterified plant oil such as rapeseed methyl ester, fuels referred to as E85 or M85, and fuels referred to as AlCool™. In one embodiment, mixtures of hydrocarbon and nonhydrocarbon fuels can be defined by ASTM D-5798-99. In one embodiment, the fuel comprises a blend of ethanol and gasoline having a ratio from 10:90 to 90:10, or 15:85 to 90:10, or 25:75 to 90:10. In an embodiment, the fuel can be an emulsion of water in a hydrocarbon fuel, in a nonhydrocarbon fuel, or a mixture thereof. In some embodiments, the fuel can have a sulfur content on a weight basis of 5000 ppm or less, 1000 ppm or less, 300 ppm or less, 200 ppm or less, 30 ppm or less, or 10 ppm or less. In another embodiment, the fuel can have a sulfur content on a weight basis of 1 to 100 ppm. In one embodiment, the fuel contains 0 ppm to 1000 ppm, or 0 to 500 ppm, or 0 to 100 ppm, or 0 to 50 ppm, or 0 to 25 ppm, or 0 to 10 ppm, or 0 to 5 ppm, of alkali metals, alkaline earth metals, transition metals, or mixtures thereof. In another embodiment, the fuel contains 1 to 10 ppm by weight of alkali metals, alkaline earth metals, transition metals, or mixtures thereof. It is well known in the art that a fuel containing alkali metals, alkaline earth metals, transition metals or mixtures thereof have a greater tendency to form deposits and therefore foul or plug injectors. The fuel can be present in a fuel composition in a major amount that is generally greater than 50 percent by weight, and in other embodiments is present at greater than 90 percent by weight, greater than 95 percent by weight, greater than 99.5 percent by weight, or greater than 99.8 percent by weight.

The fuel compositions can further comprise one or more additional performance additives. Additional performance additives can be added to a fuel composition depending on several factors including the type of internal combustion engine and the type of fuel being used in that engine, the quality of the fuel, and the service conditions under which the engine is being operated. The additional performance additives can include an antioxidant such as a hindered phenol or derivative thereof and/or a diarylamine or derivative thereof, a corrosion inhibitor such as an alkenylsuccinic acid, and/or a detergent/dispersant additive such as a polyetheramine or nitrogen containing detergent, including PIB amine detergent/dispersant, quaternary salt detergent/dispersant, succinimide detergent/dispersant and Mannich detergent/dispersant. The additional performance additives may also include a cold flow improver such as an esterified copolymer of maleic anhydride and styrene and/or a copolymer of ethylene and vinyl acetate, a foam inhibitor such as a silicone fluid, a demulsifier such as a polyalkoxylated alcohol, a lubricity agent such as a fatty carboxylic acid, a metal deactivator such as an aromatic triazole or derivative thereof, a valve seat recession additive such as an alkali metal sulfosuccinate salt, a biocide, an antistatic agent, a deicer, a fluidizer such as a mineral oil and/or a poly(alpha-olefin) and/or a polyether, and a combustion improver such as an octane or cetane improver.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, including aliphatic, alicyclic, and aromatic substituents; substituted hydrocarbon substituents, that is, substituents containing non-hydrocarbon groups which, in the context of this invention, do not alter the predominantly hydrocarbon nature of the substituent; and hetero substituents, that is, substituents which similarly have a predominantly hydrocarbon character but contain other than carbon in a ring or chain. A more detailed definition of the term "hydrocarbyl substituent" or "hydrocarbyl group," including permissible amounts of other atoms, is found in paragraphs [0137] to [0141] of published application US 2010-0197536.

The metal-containing detergent which is present as an additive component in the lubricant is, in one embodiment, an overbased detergent. It may, alternatively, be a neutral detergent. Overbased materials, otherwise referred to as overbased or superbased salts, are generally homogeneous Newtonian systems characterized by a metal content in excess of that which would be present for neutralization according to the stoichiometry of the metal and the particular acidic organic compound reacted with the metal. The overbased materials are prepared by reacting an acidic material (typically an inorganic acid or lower carboxylic acid, preferably carbon dioxide) with a mixture comprising an acidic organic compound (in this instance, a hydrocarbyl-substituted salicylic acid), a reaction medium comprising at least one inert, organic solvent (e.g., mineral oil, naphtha, toluene, xylene) for said acidic organic material, a stoichiometric excess of a metal base, and a promoter such as a phenol or alcohol and optionally ammonia. The acidic organic material will normally have a sufficient number of carbon atoms, for instance, as a hydrocarbyl substituent, to provide a reasonable degree of solubility in oil. The amount of excess metal is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5.

Overbased detergents are often characterized by Total Base Number (TBN). TBN is the amount of strong acid needed to neutralize all of the over-based material's basicity, expressed as potassium hydroxide equivalents (mg KOH per gram of sample). Since overbased detergents are commonly provided in a form which contains a certain amount of diluent oil, for example, 40-50% oil, the actual TBN value for such a detergent will depend on the amount of such diluent oil present, irrespective of the "inherent" basicity of the overbased material. For the purposes of the present invention, the TBN of an overbased detergent is to be recalculated to an oil-free basis. Detergents which are useful in the present invention typically have a TBN (oil-free basis) of 100 to 800, and in one embodiment 150 to 750, and in another, 400 to 700. If multiple detergents are employed, the overall TBN of the detergent component (that is, an average of all the specific detergents together) will typically be in the above ranges.

The metal compounds useful in making the basic metal salts are generally any Group 1 or Group 2 metal compounds (CAS version of the Periodic Table of the Elements). The Group 1 metals of the metal compound include Group 1a alkali metals such as sodium, potassium, and lithium, as well as Group 1b metals such as copper. The Group 1 metals can be sodium, potassium, lithium and copper, and in one embodiment sodium or potassium, and in another embodiment, sodium. The Group 2 metals of the metal base include the Group 2a alkaline earth metals such as magnesium, calcium, and barium, as well as the Group 2b metals such as zinc or cadmium. In one embodiment the Group 2 metals are magnesium, calcium, barium, or zinc, and in another embodiments magnesium or calcium. In certain embodiments the metal is calcium or sodium or a mixture of calcium and sodium. Generally the metal compounds are delivered as metal salts. The anionic portion of the salt can be hydroxide, oxide, carbonate, borate, or nitrate.

In one embodiment, detergent may comprise a salicylate detergent, which may, in turn, be an overbased calcium hydrocarbyl-substituted salicylate detergent. The presence of a salicylate detergent may be beneficial in providing oxidation resistance to the lubricant. In one embodiment the salicylate detergent has a Total Base Number of 120 to 800, or 200 to 700, or 300 to 600 on an oil free basis, that is, factoring out the effect of diluent oil. Salicylate detergents are known; see, for instance, U.S. Pat. No. 5,688,751 or U.S. Pat. No. 4,627,928.

Overbased materials are well known to those skilled in the art. Patents describing techniques for making basic salts of sulfonic acids, carboxylic acids, (hydrocarbyl-substituted) phenols, phosphonic acids, and mixtures of any two or more of these include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109.

The amount of the detergent is in the lubricants of the present technology may be 0.05 to 1.5 percent by weight, or 0.1 to 1 percent or 0.3 to 0.8 percent. The amount in a concentrate will be correspondingly higher. In one embodiment, these amounts may refer to the amount of the salicylate detergent present. In other embodiments, these amounts may refer to the total amount of all metal-containing detergents that may be present.

Other detergents, based on substrates other than a hydrocarbyl salicylic acid, may be present in the lubricant in place of or in addition to a salicylate detergent. In one embodiment the lubricants may contain an overbased sulfonate detergent. Oil-soluble sulfonates can be represented by one of the following formulas: $R^2$-T-$(SO_3)_a$ and $R^3$—$(SO_3—)_b$, where T is a cyclic nucleus such as typically benzene; $R^2$ is an aliphatic group such as alkyl, alkenyl, alkoxy, or alkoxyalkyl; $(R^2)$-T typically contains a total of at least 15 carbon atoms; and $R^3$ is an aliphatic hydrocarbyl group typically containing at least 15 carbon atoms. Examples of $R^3$ are alkyl, alkenyl, alkoxyalkyl, and carboalkoxyalkyl groups. In one embodiment the sulfonate detergent may be a predominantly linear alkylbenzenesulfonate detergent having a metal ratio of at least 8, as described in paragraphs [0026] to [0037] of US Patent Application 2005-065045. The linear alkyl group may be attached to the benzene or toluene at any location along the linear alkyl chain, such as at the 2, 3, or 4 position.

Another overbased material which can be present is an overbased phenate detergent. The phenols useful in making phenate detergents can be represented by the formula $(R^1)_a$—Ar—$(OH)_b$, wherein $R^1$ is an aliphatic hydrocarbyl group of 4 to 400 carbon atoms, or 6 to 80 or 6 to 30 or 8 to 25 or 8 to 15 carbon atoms; Ar is an aromatic group (which can be a benzene group or another aromatic group such as naphthalene); a and b are independently numbers of at least one, the sum of a and b being in the range of two up to the number of displaceable hydrogens on the aromatic nucleus or nuclei of Ar. In one embodiment, a and b are independently numbers in the range of 1 to 4, or 1 to 2. $R^1$ and a are typically such that there is an average of at least 8 aliphatic carbon atoms provided by the $R^1$ groups for each phenol compound. Phenate detergents are also sometimes provided as sulfur-bridged species.

In one embodiment, the overbased material is an overbased saligenin detergent. Overbased saligenin detergents are commonly overbased magnesium salts which are based on saligenin derivatives. Saligenin detergents are disclosed in greater detail in U.S. Pat. No. 6,310,009, with special reference to their methods of synthesis (Column 8 and Example 1) and suitable amounts of the various species of X and Y (Column 6).

Salixarate detergents may also be present. Salixarates and methods of their preparation are described in greater detail in U.S. Pat. No. 6,200,936 and PCT Publication WO 01/56968. It is believed that the salixarate derivatives have a predominantly linear, rather than macrocyclic, structure, although both structures are intended to be encompassed by the term "salixarate."

Other overbased detergents can include overbased detergents having a Mannich base structure, as disclosed in U.S. Pat. No. 6,569,818.

If both a salicylate detergent and an additional overbased detergent are present, the amount of the additional overbased detergent (that is, in addition to the salicylate detergent), if any, in the formulations of the present invention, may be 0.05 to 1.5 weight percent, or 0.1 to 1 percent or 0.2 to 0.5%. Either a single detergent or multiple additional detergents can be present.

Additional conventional components may be used in preparing a lubricant according to the present technology, for instance, those additives typically employed in a crankcase lubricant. Crankcase lubricants may typically contain any or all of the following components hereinafter described.

One such additive is a dispersant. Dispersants are well known in the field of lubricants and include what are known as ashless-type dispersants and polymeric dispersants. Ashless type dispersants are characterized by a polar group attached to a relatively high molecular weight hydrocarbon chain. Typical ashless dispersants include nitrogen-containing dispersants such as N-substituted long chain alkenyl succinimides, also known as succinimide dispersants. Succinimide dispersants are more fully described in U.S. Pat. Nos. 4,234,435, 3,172,892, and 6,165,235 and in EP 0355895. In one embodiment, the succinimide dispersant is prepared by a chlorine-based or conventional route (a), as described in U.S. Pat. No. 7,615,521, col. 3 lines 20-15 and col. 4 lines 17-60. In another embodiment, the succinimide is prepared in a thermal or chlorine-free or direct-alkylation route (b), as described in U.S. Pat. No. 7,615,521, col. 3 line 26 to col. 4 line 15 and col. 4 line 62 to col. 5 line 26. Mixtures of types of succinimide dispersants are also contemplated. Another class of ashless dispersant is high molecular weight esters, prepared by reaction of a hydrocarbyl acylating agent and a polyhydric aliphatic alcohol such as glycerol, pentaerythritol, or sorbitol. Such materials are described in more detail in U.S. Pat. No. 3,381,022. Another class of ashless dispersant is Mannich bases. These are materials which are formed by the condensation of a higher molecular weight, alkyl substituted phenol, an alkylene polyamine, and an aldehyde such as formaldehyde and are described in more detail in U.S. Pat. No. 3,634,515. Other dispersants include polymeric dispersant additives, which are generally hydrocarbon-based polymers which contain polar functionality to impart dispersancy characteristics to the polymer. Dispersants can also be post-treated by reaction with any of a variety of agents. Among these are urea, thiourea, dimercaptothiadiazoles, carbon disulfide, aldehydes, ketones, carboxylic acids, hydrocarbon-substituted succinic anhydrides, nitriles, epoxides, boron compounds, and phosphorus compounds. References detailing such treatment are listed in U.S. Pat. No. 4,654,403. The amount of dispersant in the present composition can typically be 1 to 10 weight percent, or 1.5 to 9.0 percent, or 2.0 to 8.0 percent, all expressed on an oil-free basis.

Another component is an antioxidant, sometimes referred to an ashless antioxidant, if it is desired to distinguish metal-containing materials from metal-free (ashless) compounds. Antioxidants encompass phenolic antioxidants, which may comprise a butyl substituted phenol containing 2 or 3 t-butyl groups. The para position may also be occupied by a hydrocarbyl group or a group bridging two aromatic rings. They may also contain an ester group at the para position, for example, an antioxidant of the formula

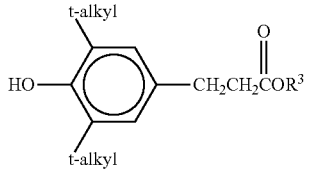

wherein $R^3$ is a hydrocarbyl group such as an alkyl group containing, e.g., 1 to 18 or 2 to 12 or 2 to 8 or 2 to 6 carbon atoms; and t-alkyl can be t-butyl. Such antioxidants are described in greater detail in U.S. Pat. No. 6,559,105. Antioxidants also include aromatic amines, such as nonylated diphenylamines. Other antioxidants include sulfurized olefins, titanium compounds, and molybdenum compounds. U.S. Pat. No. 4,285,822, for instance, discloses lubricating oil compositions containing a molybdenum and sulfur containing composition. Typical amounts of antioxidants will, of course, depend on the specific antioxidant and its individual effectiveness, but illustrative total amounts can be 0.01 to 5 percent by weight or 0.15 to 4.5 percent or 0.2 to 4 percent. Additionally, more than one antioxidant may be present, and certain combinations of these can be synergistic in their combined overall effect.

Viscosity improvers (also sometimes referred to as viscosity index improvers or viscosity modifiers) may be included in the compositions of this invention. Viscosity improvers are usually polymers, including polyisobutenes, polymethacrylic acid esters, hydrogenated diene polymers, polyalkylstyrenes, esterified styrene-maleic anhydride copolymers, hydrogenated alkenylarene-conjugated diene copolymers and polyolefins. Multifunctional viscosity improvers, which also have dispersant and/or antioxidancy properties are known and may optionally be used. Viscosity improvers may be used at, e.g., 0.1 to 0.8 percent or 0.3 to 0.6 percent by weight.

Another additive is an antiwear agent. Examples of antiwear agents include phosphorus-containing antiwear/extreme pressure agents such as metal thiophosphates, phosphoric acid esters and salts thereof, phosphorus-containing carboxylic acids, esters, ethers, and amides; and phosphites. The present technology is particularly useful for formulations in which the total amount of phosphorus as delivered by various components including the antiwear agent, does not exceed or is less than 0.075% or 0.07% or 0.06%. Suitable amounts may include 0.005 to about 0.055 percent by weight or 0.01 to 0.05 percent or 0.02 to 0.05 percent. Often the antiwear agent is a zinc dialkyldithiophosphate (ZDP). For a typical ZDP, which may contain 10 percent P (calculated on an oil free basis), suitable amounts may include 0.05 to 0.6 or 0.05 to 0.55 or 0.1 to 0.5 or 0.2 to 0.5 percent by weight, thus contributing phosphorus in corresponding amounts, such as up to 0.075 weight percent or 0.005 to 0.06 weight percent, or other amounts as described above. Non-phosphorus-containing anti-wear agents, which may also be used, include borate esters (including borated epoxides), dithiocarbamate compounds, molybdenum-containing compounds, and sulfurized olefins.

Other additives that may optionally be used in lubricating oils include pour point depressing agents, extreme pressure agents, anti-wear agents, color stabilizers and anti-foam agents.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present technology; the present technology encompasses the composition prepared by admixing the components described above.

The present technology is particularly useful also when the total sulfated ash of a lubricant is relatively low, for instance, less than 1% or less than 0.8%, e.g., 0.01 to 0.8, or 0.1 to 0.75, or 0.2 to 0.7 percent.

EXAMPLES

A series of test lubricant formulations are prepared. Each formulation includes, in addition to the specific materials mentioned in the table below, the following materials, which are held constant: 5.5% olefin copolymer viscosity modifier (including 91% diluent oil) 4.0% of a succinimide dispersant (47% oil), 1.75% antioxidants (aromatic amine, sulfurized olefin, and hindered phenolic ester), 0.65% sodium and calcium arenesulfonate detergents (31-42% oil), 0.48% friction modifiers (glycerol monooleate, fatty amide, and vegetable oil) 0.15% polymethacylate pour point depressant (50% oil), and 0.009% commercial anti-foam agent, all in a mineral base oil.

In the lubricant formulations are included the materials shown in the table below, in addition to those listed in the previous paragraph. The resulting lubricant formulations are tested for oxidative stability by a pressurized differential scanning calorimetry test (CEC L-85). The time of onset of oxidation is a measure of relative oxidative stability.

| | High P | | | Low P | | |
|---|---|---|---|---|---|---|
| Amounts, % | Ex 1* | Ex 2* | Ex 3* | Ex 4* | Ex 5* | Ex 4 |
| ZDDP 1, 10% P overall (including 9% oil) | 0.20 | 0.20 | 0.20 | 0.13 | 0.13 | 0.13 |
| ZDDP 2, 8.5% P overall (including 8% oil) | 0.66 | 0.66 | 0.66 | 0.44 | 0.44 | 0.44 |
| Total P level | 0.076 | 0.076 | 0.076 | 0.050 | 0.050 | 0.050 |
| Polyether fluidizer (a) | | 2.0 | 2.0 | | 2.0 | 2.0 |
| Ca sulfonate, overbased, 12% calcium, incl. 42% oil (to provide 0.106% Ca) | 0.880 | 0.880 | | 0.880 | 0.880 | |
| Ca salicylate, overbased, 10% calcium, incl. 45% oil (to provide 0.106% Ca) | | | 1.056 | | | 1.056 |
| Base oil | Balance to total 100% | | | | | |
| PDSC (onset time, minutes) | 87.1 | 68.3 | 74.2 | 36.1 | 63.1 | 69.1 |

*A comparative or reference example (a) $C_{12-15}$ alcohol-initiated propylene oxide alkoxylate (24 propylene oxide units nominally), terminated with an OH group.

The results show that, in high phosphorus formulations, the presence of polyether provides no improvement. On the other hand, in low phosphorus formulations, the initial oxidative stability is initially significantly worse, presumably due to the lower amount of ZDDP which serves as an antioxidant. Under these conditions, however, the presence of 2% polyether leads to a significant improvement in the oxidative stability, which is further improved by switching from sulfonate to salicylate detergent.

Each of the documents referred to above is incorporated herein by reference. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about." It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

What is claimed is:

1. A method for lubricating a sump-lubricated, spark-ignited engine, comprising supplying to said engine a lubricant which comprises:

(a) an oil of lubricating viscosity;

(b) about 0.1 to about 5 percent by weight of a polyether represented by the formula $$R^1—(—O—R^2—)_n—OR^3$$

wherein $R^1$ is a hydrocarbyl group of about 10 to about 15 carbon atoms, each $R^2$ is independently an alkylene group of 2 to 4 carbon atoms, n is about 18 to about 26, and $R^3$ is H or an alkyl group or a group of the structure $—CH_2CH_2CH_2NH_2$; and (c) a metal-containing detergent, comprising a salicylate detergent having a total base number of about 120 to about 400 (oil free basis), said salicylate detergent being present at about 0.3 to about 0.8 percent by weight of said lubricant;

said lubricant having a total phosphorus content of less than 0.075 percent by weight and wherein the lubricant comprises a zinc dihydrocarbyldithiophosphate in an amount to contribute about 0.02 to about 0.06 weight percent phosphorus.

2. The method of claim 1 wherein the polyether comprises a reaction product of one unit derived from a hydroxy-containing hydrocarbon and two or more units derived from an alkylene oxide, wherein the hydroxy-containing hydrocarbon contains about 10 to about 15 carbon atoms and the alkylene group of the alkylene oxide contains 2 to 4 carbon atoms, wherein the reaction product is optionally further reacted with acrylonitrile and hydrogenated to provide a terminal amino group.

3. The method of claim 1 wherein the salicylate detergent comprises an overbased calcium hydrocarbyl-substituted salicylate detergent.

4. The method of claim 1 wherein the phosphorus content of the lubricant is about 0.02 to about 0.05 percent by weight.

5. The method of claim 1 wherein the sulfated ash level of the lubricant is about 0.01 percent to less than about 0.80 percent.

6. The method of claim 1 wherein the lubricant further comprises an ashless antioxidant.

7. A lubricant comprising (a) an oil of lubricating viscosity;

(b) about 0.1 to about 5 percent by weight of a polyether represented by the formula $$R^1—(—O—R^2—)_n—OR^3$$

wherein $R^1$ is a hydrocarbyl group of about 10 to about 15 carbon atoms, each $R^2$ is independently an alkylene group of 2 to 4 carbon atoms, n is about 18 to about 26, and $R^3$ is H or an alkyl group or a group of the structure $—CH_2CH_2CH_2NH_2$; and (c) a metal-containing detergent, comprising a salicylate detergent having a total base number of about 12 to about 400 (oil free basis), said salicylate detergent being present at about 0.3 to about 0.8 percent by weight of said lubricant;

said lubricant having a total phosphorus content of less than about 0.075 percent by weight and wherein the lubricant comprises a zinc dihydrocarbyldithiophosphate in an amount to contribute about 0.02 to about 0.06 weight percent phosphorus.

8. The lubricant of claim 7 wherein the polyether comprises a reaction product of one unit of a hydroxy-containing hydrocarbon and two or more units of an alkylene oxide, wherein the hydroxy-containing hydrocarbon contains about 10 to about 15 carbon atoms and the alkylene group of the alkylene oxide contains 2 to 4 carbon atoms, wherein the reaction product is optionally further reacted with acrylonitrile and hydrogenated to provide a terminal amino group.

9. The lubricant of claim 7 wherein the polyether is present in an amount of about 0.5 to about 3 percent by weight.

10. The lubricant of claim 7 wherein the metal-containing detergent comprises an overbased calcium hydrocarbyl-substituted salicylate detergent.

11. A composition prepared by admixing the components of claim 7.

12. The method of claim 1 wherein the metal of the metal-containing detergent consists essentially of calcium.

13. The method of claim 1 wherein the lubricant further comprises about 0.1 to about 0.8 weight percent of a polyolefin viscosity modifier.

14. The method of claim 1 wherein, the metal of the metal-containing detergent consists essentially of calcium, and wherein the lubricant further comprises about 0.1 to about 0.8 weight percent of a polyolefin viscosity modifier.

15. The lubricant of claim 7 wherein the metal of the metal-containing detergent consists essentially of calcium, and wherein the lubricant further comprises about 0.1 to about 0.8 weight percent of a polyolefin viscosity modifier.

16. The method of claim 1 wherein (b) the polyether is present in an amount of about 0.3 to about 4 weight percent and is represented by the formula $$R^1—(—O—R^2—)_n—OR^3$$

wherein $R^1$ is a hydrocarbyl group of about 12 to about 15 carbon atoms, each $R^2$ is independently an alkylene group of 3 to 4 carbon atoms, n is about 18 to about 26, and $R^3$ is H or an alkyl group or a group of the structure $—CH_2CH_2CH_2NH_2$;

wherein (c) the metal-containing detergent, comprises an overbased calcium salicylate detergent at about 0.3 to about 0.8 percent by weight of said lubricant;

and wherein said lubricant has a total phosphorus content of 0.02 to less than 0.060 percent by weight.

17. The lubricant of claim 7 wherein (b) the polyether is present in an amount of about 0.3 to about 4 weight percent and is represented by the formula $$R^1—(—O—R^2—)_n—OR^3$$

wherein $R^1$ is a hydrocarbyl group of about 12 to about 15 carbon atoms, each $R^2$ is independently an alkylene group of 3 to 4 carbon atoms, n is about 18 to about 26, and $R^3$ is H or an alkyl group or a group of the structure $—CH_2CH_2CH_2NH_2$;

wherein (c) the metal-containing detergent, comprises an overbased calcium salicylate detergent at about 0.3 to about 0.8 percent by weight of said lubricant;

and wherein said lubricant has a total phosphorus content of 0.02 to less than 0.060 percent by weight.

* * * * *